US009315291B2

(12) United States Patent
Kelly et al.

(10) Patent No.: US 9,315,291 B2
(45) Date of Patent: Apr. 19, 2016

(54) PALLET SYSTEM FOR DISPLAY, STORAGE AND TRANSPORTATION OF BOTTLES

(71) Applicant: Polymer Solutions International, Inc., Medford, NJ (US)

(72) Inventors: Daniel E. Kelly, Medford, NJ (US); John A. Spadavecchia, Red House, VA (US); James A. Favaron, Columbia, SC (US); Jeff Jacobs, Lugoff, SC (US)

(73) Assignee: Polymer Solutions International, Inc., Medford, NJ (US)

( * ) Notice: Subject to any disclaimer, the term of this patent is extended or adjusted under 35 U.S.C. 154(b) by 0 days.

(21) Appl. No.: 14/375,197

(22) PCT Filed: Jan. 30, 2013

(86) PCT No.: PCT/US2013/023746

§ 371 (c)(1),
(2) Date: Jul. 29, 2014

(87) PCT Pub. No.: WO2013/116271

PCT Pub. Date: Aug. 8, 2013

(65) Prior Publication Data

US 2015/0001114 A1 Jan. 1, 2015

Related U.S. Application Data

(60) Provisional application No. 61/592,099, filed on Jan. 30, 2012.

(51) Int. Cl.
*B65D 19/02* (2006.01)
*B65D 19/00* (2006.01)
(Continued)

(52) U.S. Cl.
CPC ..... *B65D 19/02* (2013.01); *B65D 19/00* (2013.01); *B65D 19/0038* (2013.01);
(Continued)

(58) Field of Classification Search
CPC .... B65D 1/243; B65D 19/00; B65D 19/0038; B65D 19/02; B65D 19/44; B65D 71/0003; B65D 71/0096; B65D 71/24; B65D 71/26; B65D 71/70; B65D 2519/00034; B65D 2519/00069; B65D 2519/00273; B65D 2519/00288; B65D 2519/00308; B65D 2519/00318; B65D 2519/00333; B65D 2519/00567; B65D 2519/00796; B65D 2519/00815; B65D 2519/0094; B65D 2519/00965
USPC ..... 206/203, 427, 432, 509, 511, 560; 220/509, 513, 516, 519
See application file for complete search history.

(56) References Cited

U.S. PATENT DOCUMENTS 4,360,231 A 11/1982 Bolin
4,593,818 A 6/1986 Schenkman
(Continued)

FOREIGN PATENT DOCUMENTS

DE 8700993 U1 4/1987
DE 4337510 5/1995
(Continued)

OTHER PUBLICATIONS

International Search Report and Written Opinion issued in related International Application No. PCT/US2013/023746, dated May 24, 2013.
(Continued)

*Primary Examiner* — Bryon Gehman
(74) *Attorney, Agent, or Firm* — RatnerPrestia

(57) ABSTRACT

A pallet system may include at least one pallet having a tray portion and a pedestal portion. The tray portion may include a generally flat platform having a perimeter edge. The pedestal portion may form at least one receptacle extending beneath the platform for receiving a neck portion of a bottle positioned beneath the platform.

17 Claims, 8 Drawing Sheets

(51) Int. Cl.
*B65D 71/00* (2006.01)
*B65D 71/70* (2006.01)

(52) U.S. Cl.
CPC ..... *B65D 71/0096* (2013.01); *B65D 71/70* (2013.01); *B65D 2519/00034* (2013.01); *B65D 2519/00069* (2013.01); *B65D 2519/0094* (2013.01); *B65D 2519/00268* (2013.01); *B65D 2519/00273* (2013.01); *B65D 2519/00288* (2013.01); *B65D 2519/00308* (2013.01); *B65D 2519/00318* (2013.01); *B65D 2519/00333* (2013.01); *B65D 2519/00567* (2013.01); *B65D 2519/00796* (2013.01); *B65D 2519/00815* (2013.01); *B65D 2519/00965* (2013.01)

(56) References Cited

U.S. PATENT DOCUMENTS

| | | | | |
|---|---|---|---|---|
| 4,846,365 | A | 7/1989 | Steinlein | |
| 5,016,761 | A | 5/1991 | Stoddard | |
| 5,038,961 | A | 8/1991 | Watanabe | |
| 5,178,276 | A | 1/1993 | Sheets | |
| 5,263,605 | A | 11/1993 | Caton | |
| 5,360,112 | A * | 11/1994 | Beauchamp | 206/427 |
| 5,377,862 | A | 1/1995 | Oakes | |
| 5,651,459 | A | 7/1997 | Umiker | |
| 5,769,230 | A | 6/1998 | Koefelda | |
| 5,857,416 | A | 1/1999 | Donnell, Jr. | |
| 6,279,770 | B1 | 8/2001 | Osbakk | |
| 7,124,890 | B2 | 10/2006 | McLeod | |
| 2008/0196633 | A1 | 8/2008 | Ho | |
| 2009/0057248 | A1 | 3/2009 | Vishnevsky | |
| 2009/0301926 | A1 * | 12/2009 | Ogburn | 206/509 |
| 2011/0284411 | A1 * | 11/2011 | Delbrouck et al. | 206/427 |

FOREIGN PATENT DOCUMENTS

| | | | |
|---|---|---|---|
| DE | 202004007452 | | 10/2004 |
| EP | 0306074 | | 3/1989 |
| EP | 1652784 | A1 * | 5/2006 |
| GB | 2240326 | | 7/1991 |
| GB | 2335414 | A | 9/1999 |
| GB | 2451425 | | 2/2009 |
| WO | WO 9915427 | A1 * | 4/1999 |
| WO | 2004014754 | | 2/2004 |

OTHER PUBLICATIONS

International Preliminary Report on Patentability issued in related International Application No. PCT/US2013/023746, dated Aug. 5, 2014.

English Translation for DE 202004007452.

English Translation for DE 4337510.

Entire patent prosecution history of U.S. Appl. No. 14/375,184, filed Jul. 29, 2014, entitled, "Tray System for Display, Storage and Transportation of Bottles."

Entire patent prosecution history of U.S. Appl. No. 14/658,681, filed Mar. 16, 2015, entitled, "Tray System for Display, Storage and Transportation of Bottles."

International Search Report and Written Opinion issued in related International Application No. PCT/US2013/023742, dated May 23, 2013.

Office Action mailed Oct. 1, 2015 in U.S. Appl. No. 14/375,184.

Office Action mailed Sep. 16, 2015 in U.S. Appl. No. 14/658,681.

EPO Communication dated Nov. 16, 2015 in related EP Application No. 13 706 329.3.

* cited by examiner

PALLET SYSTEM FOR DISPLAY, STORAGE AND TRANSPORTATION OF BOTTLES

CROSS-REFERENCE TO RELATED APPLICATIONS

This application is the U.S. National Phase of PCT International Application No. PCT/US2013/023746, filed Jan. 30, 2013, and claims the benefit of priority of U.S. Application No. 61/592,099, filed Jan. 30, 2012, the contents of both applications being incorporated by reference herein in their entireties for all purposes.

FIELD

The present disclosure relates generally to apparatuses for storing and transporting containers, and more specifically to a pallet system used for displaying, storing and transporting product containers in vertically stacked arrangements.

BACKGROUND

Businesses engaged in the home-office-delivery (HOD) bottled water business face a number of challenges in delivering bottled water to customers. Bottled water businesses also face a number of challenges in retrieving empty bottles from customers, and transporting the empty bottles back to a facility for cleaning and refilling. The size, shape and weight of these bottles make them very prone to tipping over and rolling during transport to and from the customer. If the bottles are allowed to tip over and roll, the bottles can be damaged, resulting not only in spillage of water, but also in the loss of the container.

Bottled water businesses often ship bottled water to customers in bulk. The bottles are frequently shipped on wooden pallets. After bottles are placed on top of a wooden pallet, the bottles are secured against shifting by securing straps around the bottles, or by wrapping a plastic film around the pallet and bottles. For large shipments, bottles may be stacked on top of one another. A first level of bottles is placed on a pallet, and a thin sheet of plywood or other material, sometimes called a "slip sheet", is placed on top of the first level of bottles. A second level of bottles is then placed on the slip sheet. A second slip sheet may be placed on the second level of bottles to support a third level of bottles. The multi-level stack of bottles is then secured with straps or plastic film to secure the bottles together.

There are several drawbacks to using traditional pallets and slip sheets. A major drawback is the need for straps, plastic film or other means for securing the bottles together on the pallet, or between the pallet and slip sheet. This adds time and cost to the process of transporting bottles. When empty bottles are retrieved from customers, they often must be stacked in an orderly arrangement on pallets inside a truck to maximize the number of bottles that can fit inside the truck. Empty bottles are extremely light and very prone to shifting during shipping unless they are secured with plastic wrap or other securing means.

Another drawback of traditional pallets and slip sheets is instability. Even when the bottles, pallets and slip sheets are secured in plastic wrap or other securing means, the stack of bottles can still be unstable because the bottles are seldom centered over one another, allowing the stack to lean to one side.

Traditional pallets and slip sheets also pose problems when using machinery in an automated process to stack bottles. Pallets and slip sheets have flat surfaces that do not provide target areas on which to place bottles. As such, it is very difficult to load bottles onto a pallet or slip sheet in an automated process, and particularly difficult to stack bottles so that they are centered over one another in a stable arrangement.

Yet another drawback of traditional pallets and slip sheets is the stress they place on bottles. When bottles are stacked on top of one another on pallets and slip sheets, an enormous amount of load is placed on the spout and cap of each bottle, particularly the spouts and caps of bottles on the bottom level. This leads to frequent breakage of the caps during loading and shipment, resulting in loss of product.

Lastly, conventional wood pallets and slip sheets are not suitable for displaying bottles to customers in stores. Wood pallets frequently exhibit broken planks, popped nails, splintered surfaces and other features that can detract from the store display.

SUMMARY

The drawbacks of conventional systems for bottle display, storage and transportation are resolved by pallet systems in accordance with the invention.

A pallet system according to one embodiment includes at least one pallet having a tray portion and a pedestal portion. The tray portion may include a generally flat platform having a perimeter edge. The pedestal portion may form at least one receptacle extending beneath the platform for receiving a neck portion of a bottle positioned beneath the platform.

The tray portion may include a plurality of dividers extending upwardly from the platform. Alternatively, the tray portion may have no dividers. Where dividers are utilized, the dividers may collectively form a plurality of sockets for receiving containers in the tray portion. The dividers may be arc-shaped. Some of the arc-shaped dividers may be grouped in sets. Each set may consist of four arc-shaped dividers. The four arc-shaped dividers of each set may be joined end to end, so that each set forms a diamond-shaped cluster of arc-shaped dividers. The arc-shaped dividers may be arranged on a plurality of circular outlines and define circular borders around the sockets.

The tray portion may include a sidewall extending upwardly from the perimeter edge of the platform. Some of the dividers may be arranged in series along the sidewall. Dividers arranged in series along the sidewall may extend tangentially to the sidewall. The sidewall may have a first height with respect to the platform, and the dividers may have a second height with respect to the platform. The first height may be greater than the second height.

The pedestal portion may be configured to support the tray portion in a raised position above a surface on which the pedestal portion sits. The pedestal portion may include a substantially flat base and a plurality of columns that connect the tray portion to the base. The plurality of columns may be separated from one another by a plurality of apertures. Each aperture may be formed between two of the columns, and may be adapted to receive a fork on a fork lift or a pallet jack.

The at least one receptacle formed by the pedestal portion may include a plurality of receptacles passing through the base and extending beneath the platform. The at least one receptacle may be surrounded by a rim. The rim may be configured to rest on a shoulder portion of a bottle beneath the platform.

The pedestal portion may include a base having an outer edge. The sidewall of the tray portion may include an inner edge that defines an opening. The outer edge of the base may have a size and shape substantially identical to the size and shape of the opening. The at least one pallet may include a first pallet and a second pallet having a configuration identical to the first pallet. The base of the first pallet may be configured for insertion into the opening formed by the sidewall on the second pallet to facilitate nesting of the first pallet in the second pallet.

DETAILED DESCRIPTION

Although this description makes reference to specific embodiments, the invention is not intended to be limited to the details shown. Rather, various modifications may be made in the details within the scope and range of equivalents of the claims and without departing from the invention.

The foregoing drawbacks of wood pallets and slip sheets are addressed to a large extent by pallet systems in accordance with the invention, examples of which are described in this disclosure.

Figure 1:
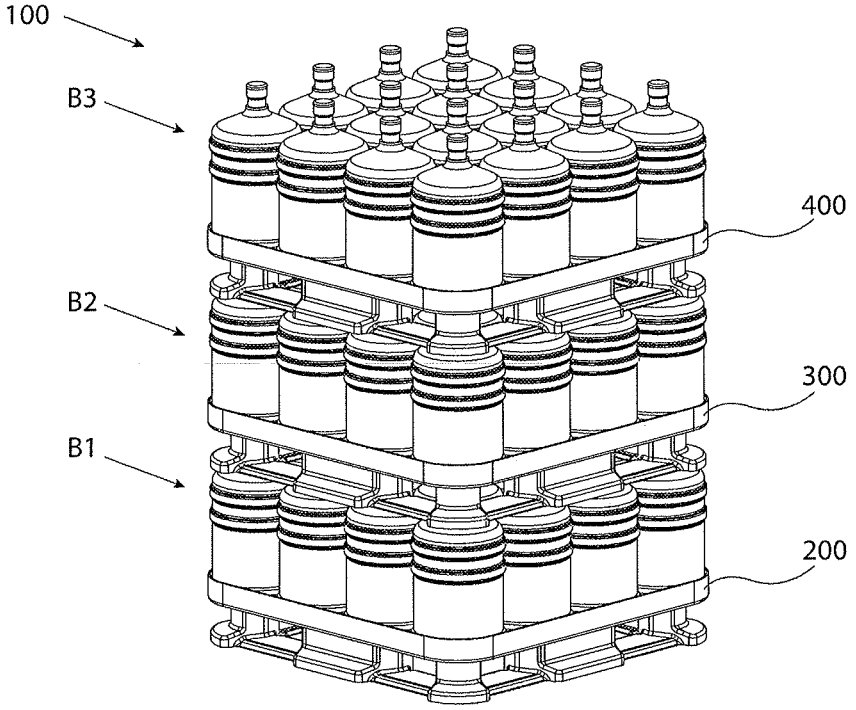
FIG. 1 is a perspective view of a pallet system in accordance with one embodiment, the pallet system featuring multiple pallets for the display, bulk storage and transportation of bottles, the pallet system shown loaded with bottles.

Pallet systems in accordance with the invention may be manufactured by injection molding, thermoforming, rotational molding or other manufacturing processes. FIG. 1 shows a pallet system 100 in accordance with one embodiment that is manufactured by injection molding. For purposes of this description, pallet system 100 is shown and described as it would be used for displaying, storing and transporting five gallon water bottles in bulk. Those skilled in the art will understand that pallet systems in accordance with the invention, such as pallet system 100, can be used for displaying, storing and transporting a variety of containers and contents, and are not necessarily designed exclusively for water bottles, or containers having a specific size, volume or shape. For example, pallet systems in accordance with the invention can be used to display, store and transport propane tanks and other cylindrical or non-cylindrical containers and packages.

Pallet systems in accordance with the invention may be used to store and transport water bottles in stacks having two or more levels of bottles. In describing pallet systems, reference will be made to one or more "first bottles", one or more "second bottles", one or more "third bottles", and so forth. The term "first bottle", as used herein, means a bottle in the bottom level in a stack. No bottles are stacked below a first bottle. The term "second bottle", as used herein, means a bottle in a level immediately above the level containing a first bottle. The term "third bottle", as used herein, means a bottle in a level immediately above the level containing a second bottle.

Figure 4:
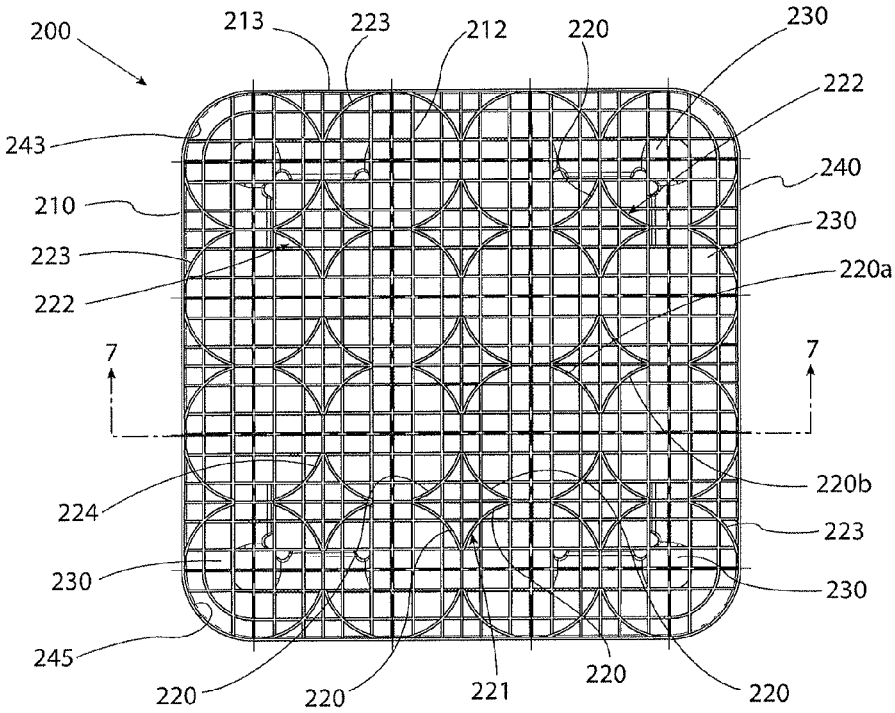
FIG. 4 is a top view of the pallet of FIG. 3.

The drawing figures contain a number of features that are shown multiple times in the same figure. For example, FIG. 4 shows a plurality of "dividers", some of which are identified with the label "220". When a feature is shown multiple times in the same drawing figure, the drawing figure may contain a label for only some of the features that are shown. This is done solely to avoid using an excessive number of labels in the same drawing, which could create clutter and obscure other features in the drawings.

Figure 2:
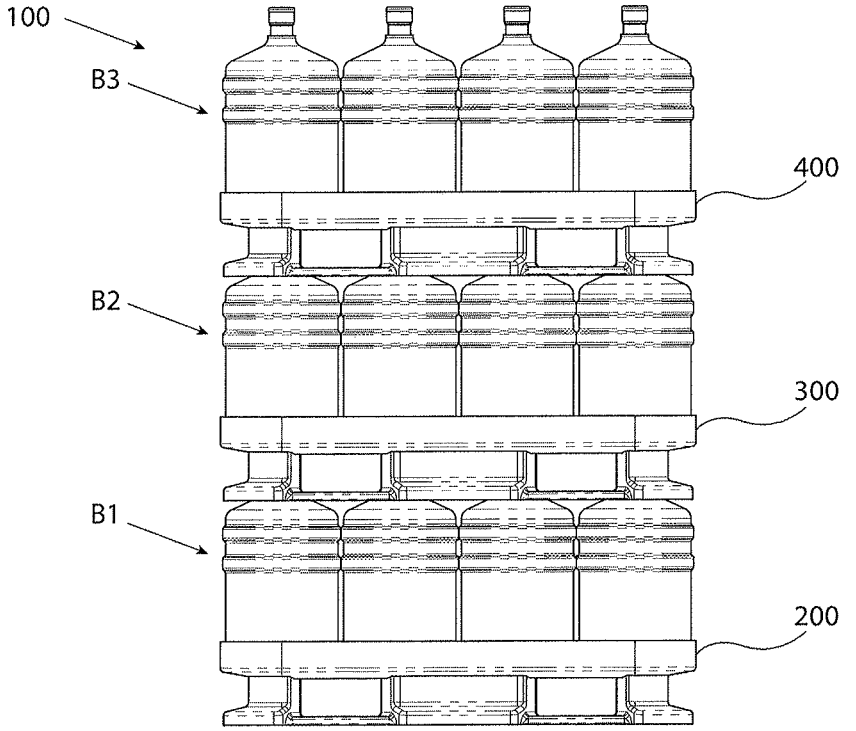
FIG. 2 is a front view of the pallet system and bottles in FIG. 1.

Pallet system 100 includes three pallets 200, 300 and 400. Pallets 200, 300 and 400 have identical configurations. As will be described, each pallet has a top structure for supporting bottles on the pallet. Each pallet also has a bottom structure for receiving the neck portions of bottles positioned beneath the pallet. When multiple pallets are used, the top and bottom structures on the pallets allow vertical stacking of bottles, with bottles stacked in an upright orientation directly above other bottles in a coaxial relationship. The term "upright", as used herein in describing a bottle, means that the bottle is oriented with its neck and spout vertically positioned above the rest of the bottle. FIGS. 1 and 2 illustrate stacking arrangements with third bottles B3 stacked vertically above second bottles B2, and second bottles B2 stacked vertically above first bottles B1, all bottles oriented in upright positions.

Figure 3:
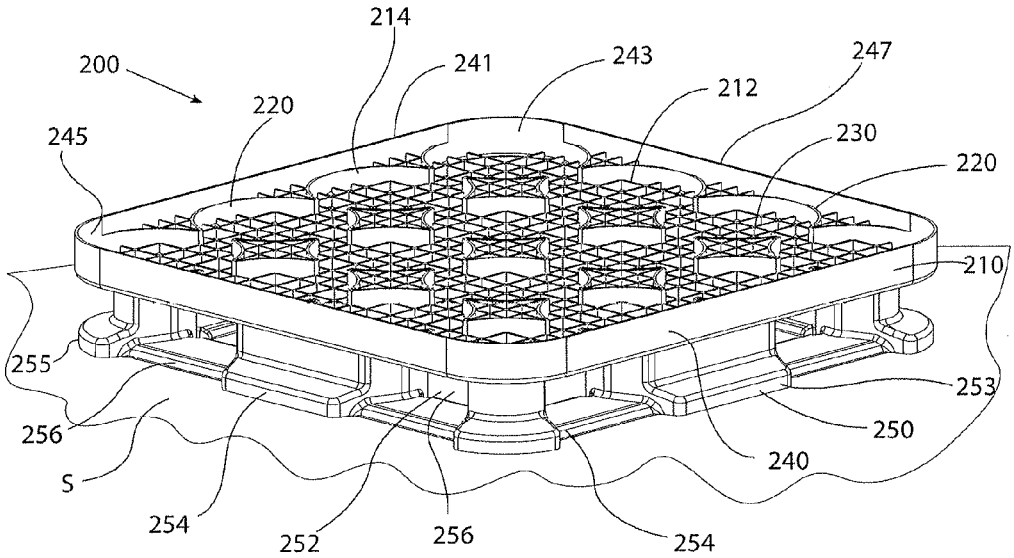
FIG. 3 is a perspective view of one of the pallets in the pallet system of FIG. 1.

For brevity, only pallet 200 will be described in this section, with the understanding that the description of pallet 200 applies equally to pallets 300 and 400. Referring to FIGS. 3 and 4, pallet 200 includes a tray portion 210 and a pedestal portion 250 extending beneath the tray portion. Tray portion 210 includes a generally flat platform 212 having a perimeter edge 213 and a plurality of dividers 220 extending upwardly from the platform. The dividers 220 collectively form a plurality of sockets 230 for receiving bottles in tray portion 210. Tray portion 210 and sockets 230 provide a visually attractive and aesthetically pleasing display apparatus for displaying vertical stacks of bottles. Tray portion 210 and sockets 230 also provide a sturdy and secure apparatus for storing and transporting bottles without the need for straps, plastic wrap or other means for securing the bottles. In particular, sockets 230 provide specific landing locations in pallet 200 that can be recognized and targeted by robotic loading equipment to facilitate the loading of empty bottles into the pallet using an automated process. These landing locations provide a specific point of reference on pallet 200 for each bottle so that the robotic loading equipment can precisely place each bottle on the pallet without interference with another bottle. The repeatable positioning of bottles in the landing locations also facilitates unloading of bottles by robotic equipment.

The landing locations provide a secure place to set empty bottles in a stable and upright position. In particular, sockets 230 support and hold the base of each empty bottle, minimizing or preventing the empty bottles from being knocked over by other bottles as the other bottles are loaded onto pallet 200. Conventional wood pallets, in contrast, have no sidewalls or sockets to create landing locations. Therefore, it is extremely difficult for automated machinery to load empty bottles onto conventional wood pallets and keep the bottles on the pallets, because the bottles are free to move and slide on the pallets. Given their extremely light weight, empty bottles can be easily knocked over or pushed off of a conventional wood pallet by other bottles being placed on the pallet. The light weight of empty bottles also makes them very prone to shifting during transport on conventional wood pallets. Therefore, conventional wood pallets that are loaded with empty bottles are typically wrapped in a plastic wrap to hold the bottles in place and prevent them from moving during transport. Pallets with sockets in accordance with the invention address all of these challenges by securely holding empty bottles in specific landing locations, making loading and transport of empty bottles much easier, while avoiding the need for straps, plastic wrap and other means for stabilizing and securing empty bottles during transport.

Pallets in accordance with the invention can feature a number of divider and socket arrangements for supporting bottles. In tray portion 210, for example, dividers 220 are arc-shaped. Where arc-shaped dividers are used, the dividers may follow various curved geometries, such as a parabolic curve, elliptical curve, a circular curve having constant radius, or any compound curvature featuring segments of different radii. Dividers 220 are circular to conform to circular bottles used in the HOD bottled water industry.

A number of dividers 220 are arranged along perimeter edge 213 of platform 212. Other dividers 220 are grouped in "sets" 221 toward the middle of platform 212. Each set 221 consists of four dividers 220. The four dividers 220 are joined end to end, so that each set forms a diamond-shaped cluster 222 of dividers. In each cluster 222, each divider 220 is oriented so that its convex side 220*a* faces inwardly toward the center of the diamond, and its concave side 220*b* faces outwardly. The dividers 220 are arranged on a plurality of circular outlines 224 and define circular wall segments around sockets 230.

Sockets 230 are arranged adjacently or tangentially to one another, as seen best in FIG. 4. This arrangement allows multiple bottles to be positioned adjacent to one another in a compact arrangement so as to reduce the overall size of the pallet and increase the number of bottles that can fit in a pallet of a specific size.

Those skilled in the art will understand that pallets in accordance with the invention need not have dividers on the platform. In fact, it is sometimes desirable to have no dividers on the platform to provide bottles with limited freedom to slide or tilt on the platform. This freedom to slide and tilt can make it easier to access bottles, and load and unload bottles to and from the pallet. Pallets that do not feature dividers on the platform may have a sidewall with contours matching the shape of bottles to create specific bottle locations that force the bottles into specific and repeatable locations.

Figure 7:
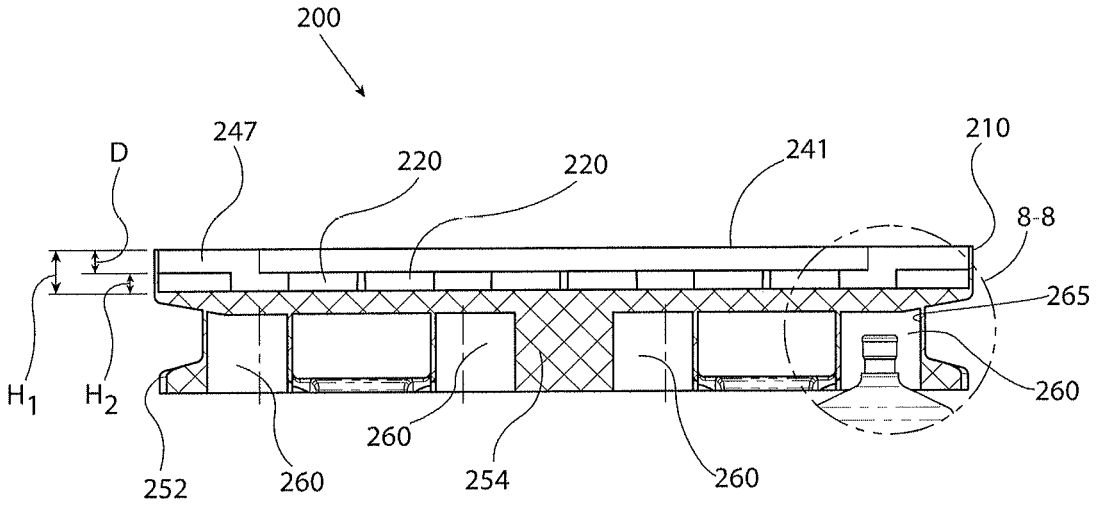
FIG. 7 is a cross section view of the pallet of FIG. 3, taken through line 7-7 of FIG. 4, with an outline of a bottle as it could be positioned in the pallet.

Tray portion 210 includes a sidewall 240 extending upwardly from perimeter edge 213 of platform 212. Referring to FIG. 7, sidewall 240 has a first height $H_1$ with respect to the platform, the first height being uniform or constant along the entire length of the sidewall. Dividers 220 have a second height $H_2$ with respect to the platform, the second height being uniform or constant for all the dividers. First height $H_1$ is greater than second height $H_2$, so that a plane passing through the top edge 241 of sidewall 240 and parallel to platform 212 extends farther above platform 212 than a similarly parallel plane passing through the top edges 214 of the dividers. The significance of heights H1 and H2 will be discussed in subsequent paragraphs.

Some of the dividers 220 are arranged in series along sidewall 240. Dividers 220 that are positioned along sidewall 240 are joined end to end with one another, with some of the ends joined at a point that intersects the sidewall. In this arrangement, dividers 220 along the sidewall join together to form four arcs 223 on each of the four sides of platform 212. Each arc 223 is tangential to sidewall 240.

Referring to FIG. 3, pallet 200 is shown as it would appear sitting on a flat surface S. Pedestal portion 250 supports tray portion 210 in a raised position above surface S. Pedestal portion 250 includes a substantially flat base 252 and a plurality of columns 254 that connect tray portion 210 to the base. Columns 254 are separated from one another by a plurality of apertures 256. Each aperture 256 is formed between two adjacent columns. Apertures 256 are adapted to receive a fork on a fork lift or pallet jack, permitting pallet 200 to be moved quickly and easily.

Figure 5:
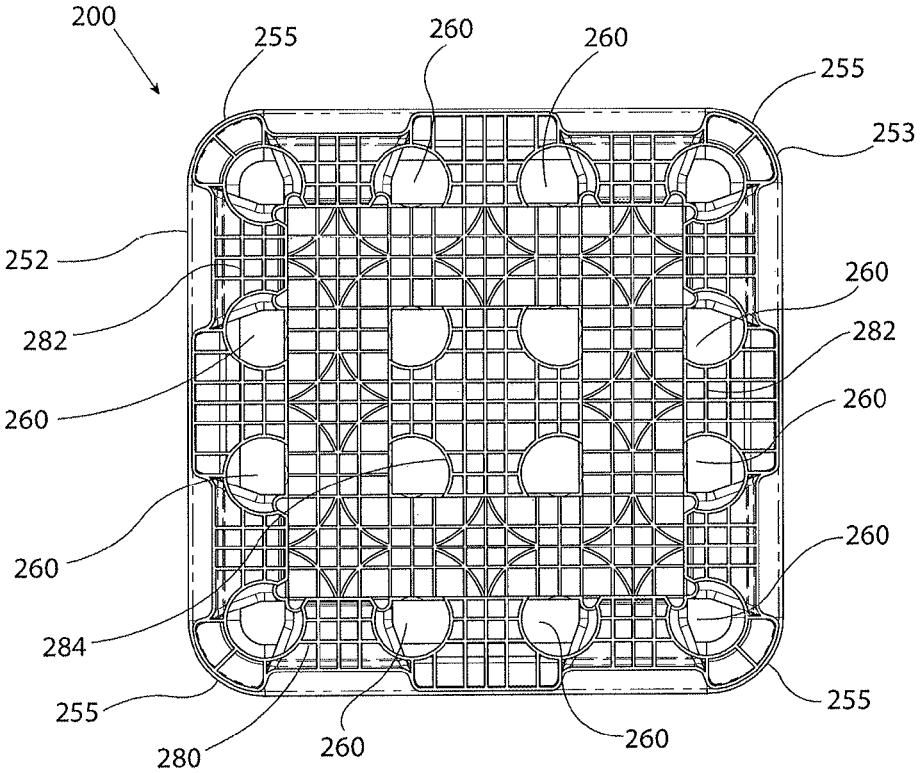
FIG. 5 is a bottom view of the pallet of FIG. 3.
Figure 6:
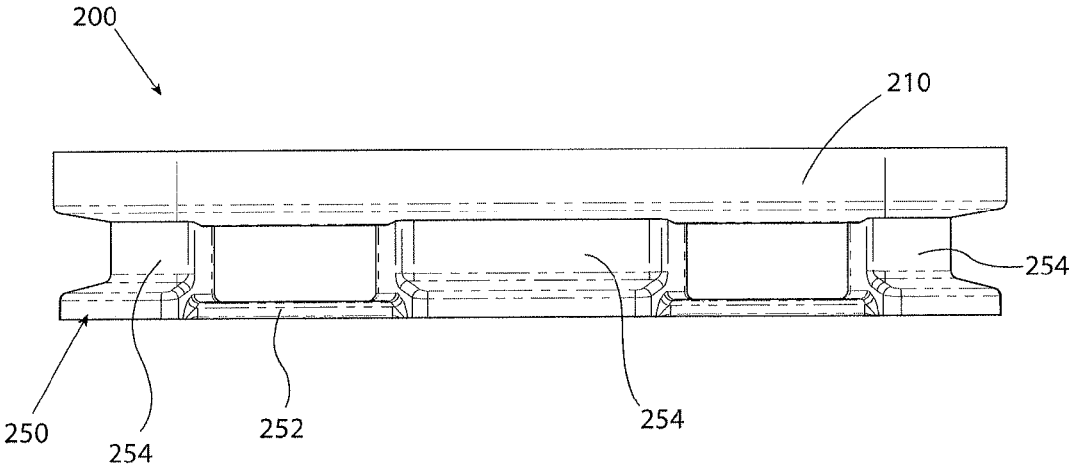
FIG. 6 is a front view of the pallet of FIG. 3, the left side view, right side view and rear view of the pallet being identical.

Pallet 200 is configured to nest with other pallets, such as pallets 300 and 400, when the pallets are empty. Referring to FIGS. 3, 5 and 7, base 252 features an outer edge 253 that is generally square shaped with rounded circular corners 255. Sidewall 240 has an inner edge 243 that also is generally square shaped with rounded corners 245. Inner edge 243 defines an opening 247. The shape defined by outer edge 253 is geometrically similar and corresponds to the shape of inner edge 243 and opening 247. Base 252 therefore conforms to the shape of opening 247. This geometric relationship allows base 252 of pallet 200 to nest within an opening of another pallet, such as pallet 300 or pallet 400, which have identical configurations. Each base on one pallet is configured for insertion into the opening of another pallet. Pallets 200, 300 and 400 can therefore be stacked in a compact arrangement when the pallets are empty. For example, pallet 400 can be stacked inside pallet 300, and pallet 300 (while supporting pallet 400) can be stacked inside pallet 200.

Opening 247 has a vertical depth D, shown in FIG. 7, that is defined by how high the sidewall 240 extends above dividers 220 relative to platform 212. That is, depth D of opening 247 is defined as the difference between height $H_1$ of sidewall 240 and height $H_2$ of dividers 220. In preferred embodiments, the height $H_1$ of sidewall 240 is at least twice the height $H_2$ of dividers 220. Other depths are suitable however. A relatively large depth allows most or all of the base to be nested within the opening of another pallet, creating overlap between adjacent stacked pallets. This overlap allows for a reduction in overall height of nested pallets, and provides stability to the stack.

Figure 8:
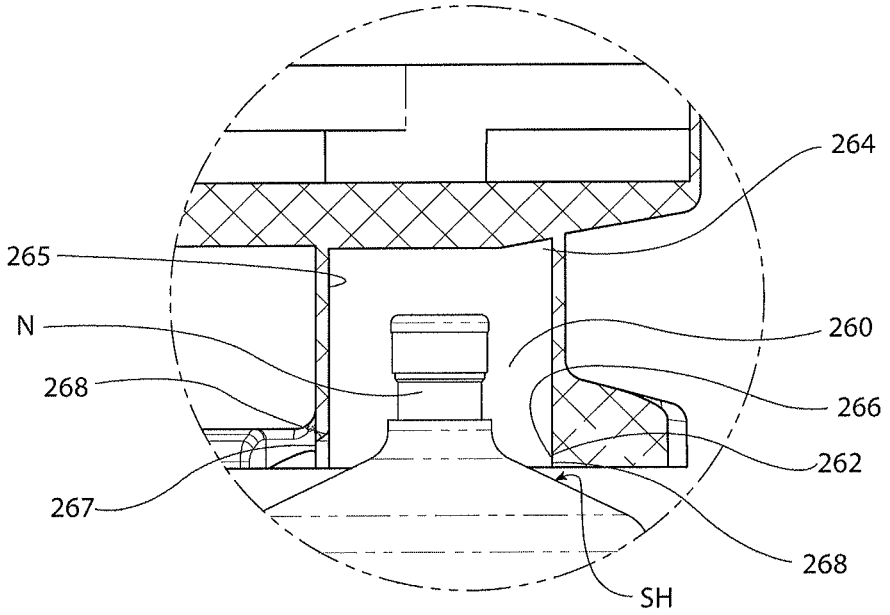
FIG. 8 is an enlarged cross section view of a portion 8-8 of FIG. 7, shown with an outline of a bottle as it could be positioned in the pallet.

Referring now to FIGS. 7 and 8, pallet 200 includes a bottom structure for receiving the neck portions of bottles positioned below the pallet. The bottom structure includes the base 252 and columns 254. Base 252 and columns 254 form a number of receptacles 260. Each receptacle 260 has a first end 262, a second end 264 opposite the first end, and a sidewall 265. First end 262 includes a rim 266 that surrounds an opening 268. Each rim 266 is configured to rest on a shoulder portion SH of a bottle.

Each receptacle 260 is adapted to surround at least a portion of and protect a neck portion N of a bottle received in the receptacle. Receptacles in accordance with the invention may include one or more surface features that permit easy insertion and removal of bottle necks into and out of the receptacles. In FIG. 8, for example, sidewall 265 includes a slot or relieved section 267 that provides additional clearance into the receptacle. This additional clearance reduces the incidence of "racking", which is a condition that occurs when the neck portion or cap of a bottle becomes jammed inside a pallet stacked above the bottle. Racking can occur when the pallet is tilted during placement onto the bottle, or lifting off of the bottle. The relieved section 267 creates a widened opening with more clearance to allow a pallet to be more easily lowered onto or lifted off of the bottle, with minimal contact or interference with the bottle neck.

Receptacles in accordance with the invention may have a number of configurations for protecting the neck of a bottle. For example, receptacles in accordance with the invention could include a plurality of wall sections arranged along the outline of a cylinder, a frustum of a cone, or other tubular construct, with gaps separating the wall sections from one another. The tubular construct may be circular, elliptical, polygonal, or have some other type of geometry for surrounding at least a portion of a bottle neck. Receptacles in accordance with the invention can include a plurality of posts interconnected by a rim, where the rim is made up of one or more sections arranged along the outline of a circle, oval, ellipse, polygon or other two-dimensional or three-dimensional shape for engaging the shoulder of a bottle.

Rims in accordance with the invention distribute the weight of bottles stacked above them onto bottles arranged below them. In FIG. 2, for example, rims that rest on the shoulder portions of the second bottles B2 distribute the weight of third bottles B3. The rims that rest on the shoulder portions of first bottles B1 distribute the weight of the second bottles B2 and third bottles B3. The weight that is distributed to the shoulder portions can be significant. Therefore, the rims may include one or more cushions or other scratch prevention materials that prevent the rims from marring the shoulder portions of underlying bottles when the pallets are loaded. Cushions or other scratch prevention materials may be in the form of gaskets that surround the rims. For example, a gasket formed of a soft elastomeric material, such as Santoprene™ brand thermoplastic vulcanizate, can be used. A gasket can be attached to each rim using an adhesive or other bonding technique.

Referring to FIG. 5, pallet 200 includes a total of sixteen receptacles 260. This provides a receptacle 260 for every bottle that is loaded beneath pallet 200, assuming that all bottle spaces in the underlying pallet are loaded with a bottle. As such, the weight of pallet 200 and its contents can be distributed to as many as sixteen bottles that are loaded beneath the pallet. Pallets in accordance with the invention need not be provided with a receptacle 260 for every bottle loaded beneath the pallet, however. That is, receptacles need not be provided beneath every socket. For example, a pallet in accordance with the invention may only have receptacles beneath sockets along the perimeter of the pallet, and omit receptacles beneath sockets toward the center or interior of the pallet. Alternatively, receptacles may only be provided beneath sockets toward the center or interior of the pallet, and not be provided beneath sockets along the perimeter of the pallet. Either option is easily visualized by omitting some of the receptacles shown in the drawing figures.

Pallet 200 has a reinforcing rib structure 280 that includes a number of straight members 282 and curved members 284. Rib structure 280 can be produced by injection molding, as noted above. When other manufacturing processes are used to manufacture the pallet, like thermoforming, the pallet may not have a rib structure.

Figure 9:
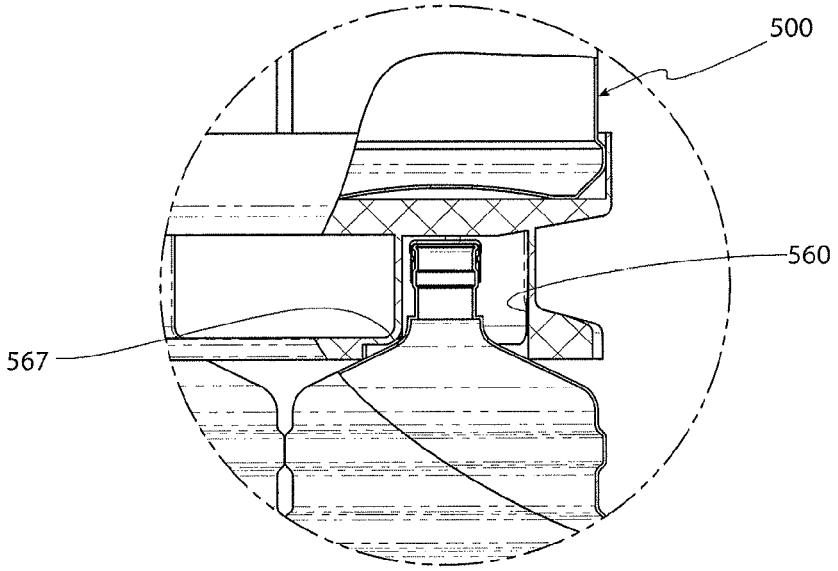
FIG. 9 is an enlarged cross section view of a portion of a pallet in accordance with another embodiment, shown with an outline of a bottle as it could be positioned in the pallet.

FIG. 9 shows an alternative embodiment of a pallet 500 with a different receptacle 560. Receptacle 560 includes a rounded edge 567 on one side of the receptacle. Rounded edge 567 provides a wider opening into the receptacle 560.

Figure 10:
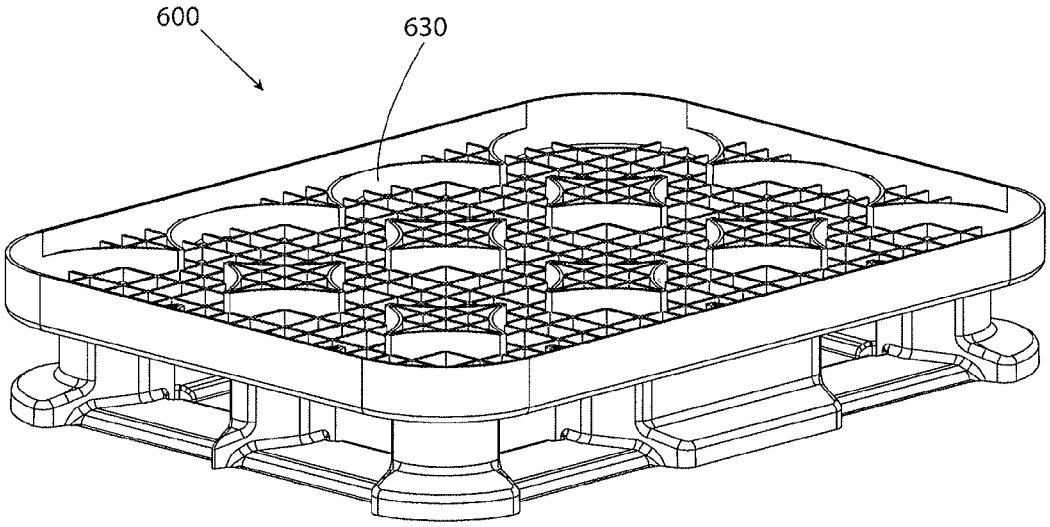
FIG. 10 is a perspective view of a pallet in accordance with another embodiment.
Figure 11:
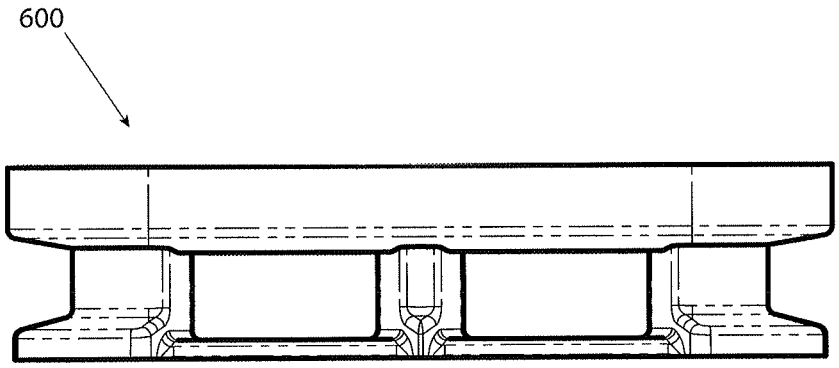
FIG. 11 is a front view of the pallet of FIG. 10, the rear view being identical.
Figure 12:
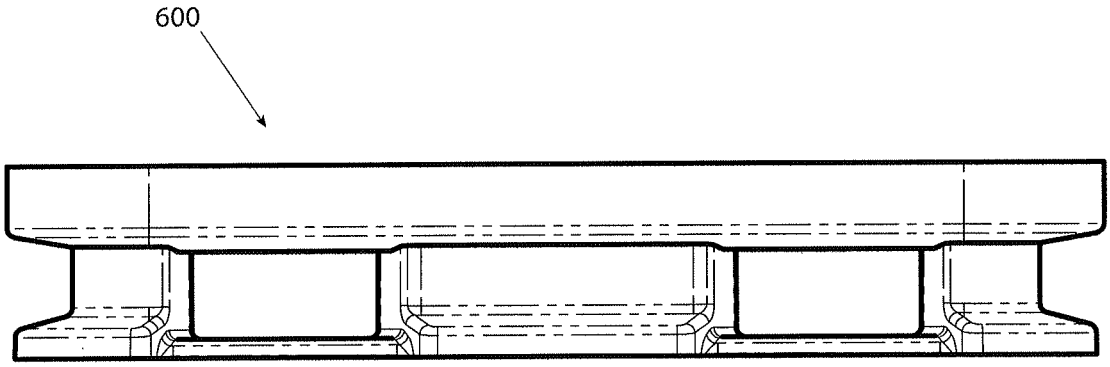
FIG. 12 is right side view of the pallet of FIG. 10, the left side view being identical.

Referring to FIGS. 10-12, another pallet 600 in accordance with an exemplary embodiment is shown. Pallet 600 is similar in many respects to pallets 200, 300 and 400, but features sockets 630 arranged in three rows and four columns.

Pallets in accordance with the invention may include any number of sockets, and thus any number and arrangement of bottles. The bottles can be stacked in two or more rows extending in a first direction, and two or more columns extending in a second direction perpendicular to the first direction. The rows and columns may have alternating numbers of sockets, or a constant number of sockets. Those skilled in the art will appreciate that pallet systems in accordance with the invention need not have arrangements of sockets as shown in the drawings. Pallets in accordance with the invention can have fewer or more sockets in each row and each column. Moreover, pallets in accordance with the invention need not have a socket for every bottle to be placed on the pallet. For example, a pallet may have dividers forming sockets along the perimeter of the pallet, but no dividers forming sockets toward the interior or center of the pallet. This arrangement would allow placement of bottles along the perimeter in a more contained and stable arrangement, while allowing bottles in the interior or center portion of the pallet more freedom to slide. Such an arrangement would appear the same as the arrangement in FIG. 3, but without the dividers 220 that form the four circular sockets in the center of the pallet.

Pallet systems in accordance with the invention may be manufactured to meet industry standard dimensions for different markets, and to accommodate different sized bottles. For example, pallets in accordance with the invention may include standard dimensions used in the U.S. market, or standard dimensions used in the European market. Those skilled in the art will understand that pallets in accordance with the invention can have other dimensions to meet customer specifications, and/or to accommodate different bottle sizes.

The tray portion, pedestal portion, dividers and other elements may be integrally attached to one another, as shown in FIGS. 1-12, so as to form a single homogenous pallet of unitary construction. Alternatively, two or more elements may be molded as separate components that can be modularly connected to one another. For example, the tray portion and pedestal portion can be manufactured as separate parts that can be detachably connected to one another with spring tabs and slots, or with other releasable connectors. Pallets in accordance with the invention are preferably manufactured with materials that offer extremely long product life. Unlike wood pallets and slip sheets, pallets in accordance with the invention can be manufactured with durable warp-resistant materials that are reusable and recyclable.

Figure 13:
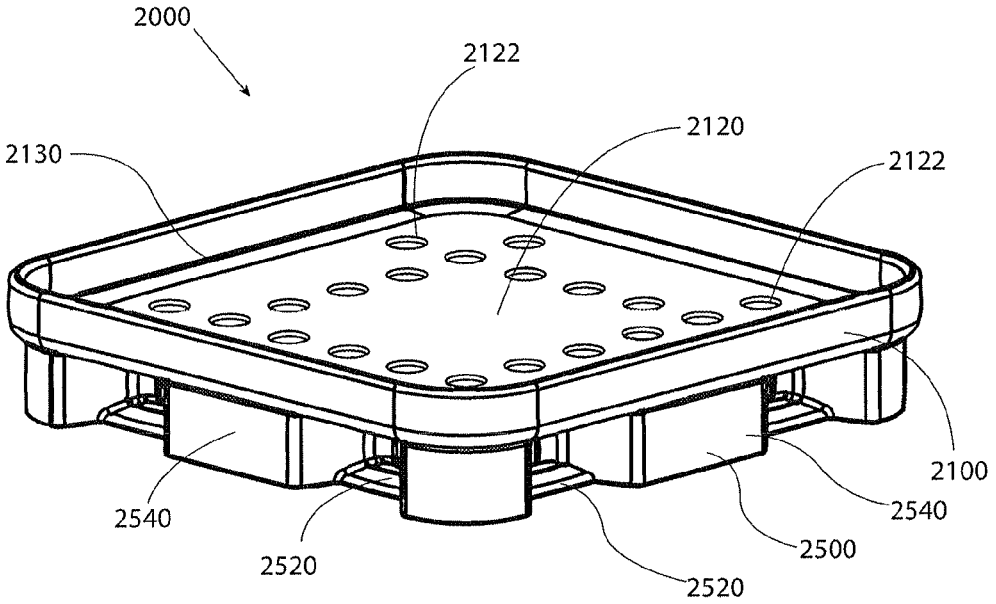
FIG. 13 is a perspective view of a pallet in accordance with another embodiment.
Figure 14:
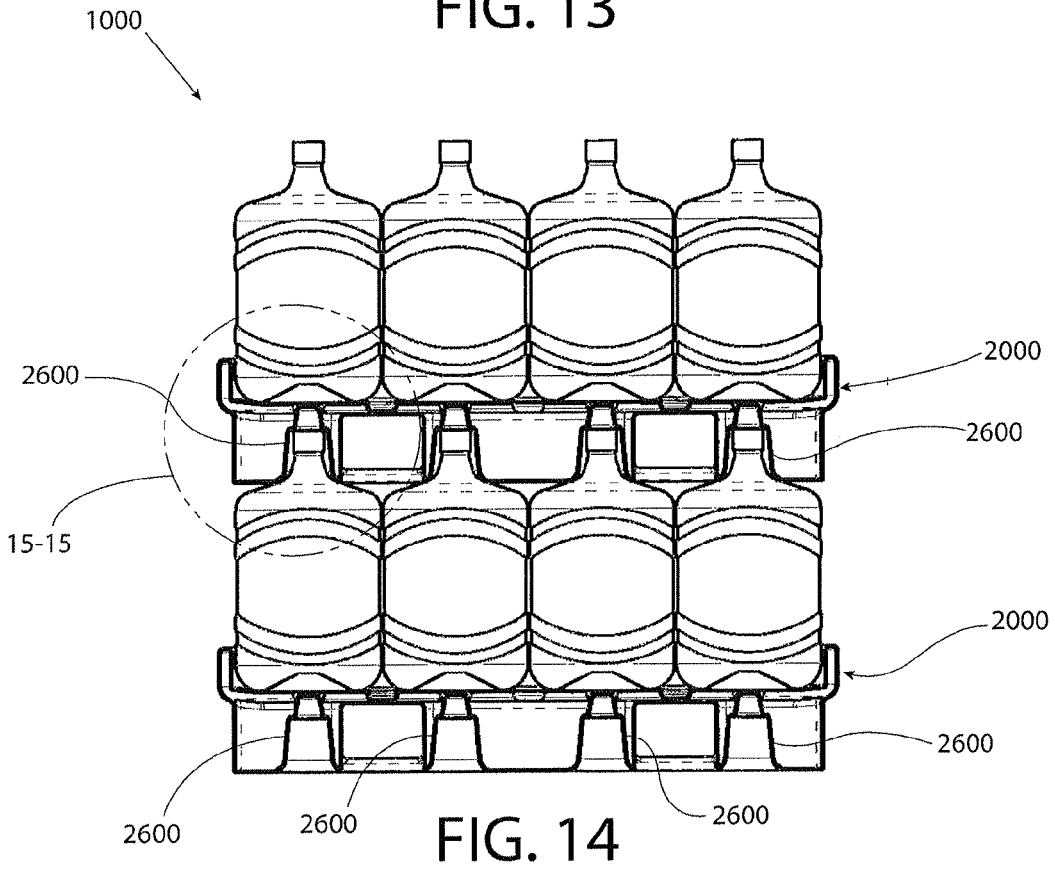
FIG. 14 is a front cross section view of the pallet of FIG. 13, shown with another identical pallet in a pallet system containing bottles stacked in two levels.
Figure 15:
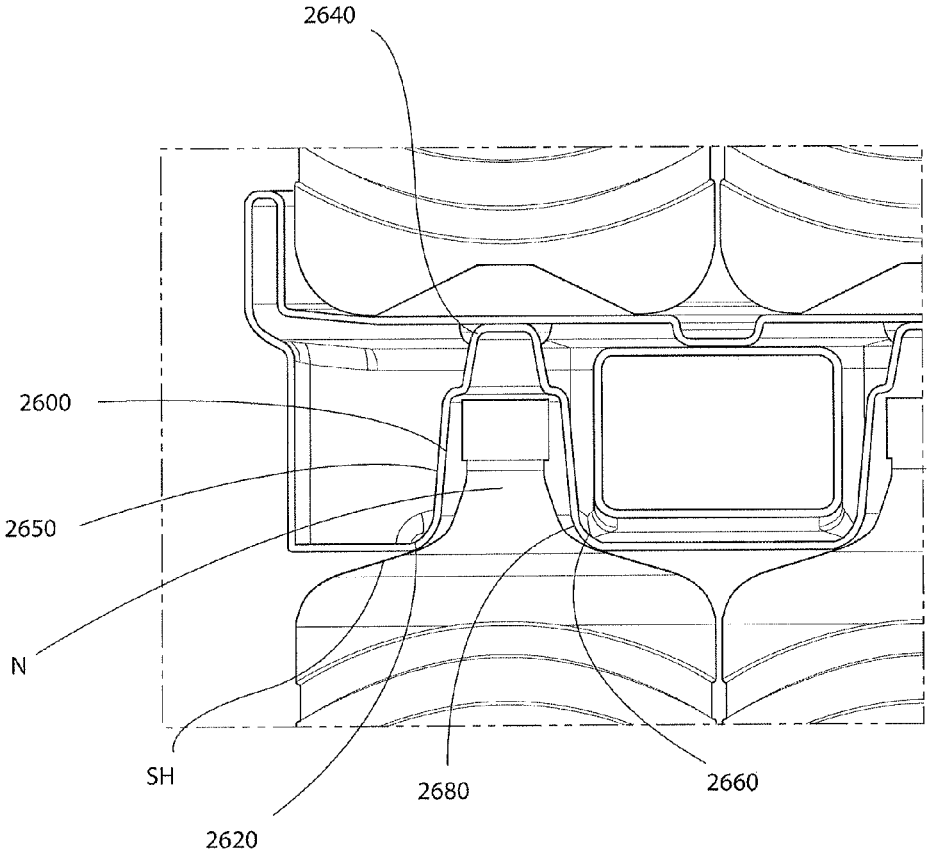
FIG. 15 is an enlarged cross section view of a portion 15-15 of the pallet system of FIG. 14.

Referring to FIGS. 13-15, a pallet 2000 and pallet system 1000 are shown in accordance with another embodiment. Pallet 2000 can be formed by a number of manufacturing processes, including but not limited to rotational molding and blow molding processes. For purposes of description, pallet 2000 is described as it would be formed by rotational molding. Pallet 2000 includes a tray portion 2100 and a pedestal portion 2500 extending beneath the tray portion. Tray portion 2100 includes a generally flat platform 2120 having a perimeter edge 2130. Unlike pallet 200, platform 2120 of pallet 2000 may or may not have dividers forming multiple sockets. Bottles that are placed on platform 2120 are free to slide or shift slightly, which can sometimes make it easier to load bottles onto pallet 2000 or remove bottles from the pallet.

Pallet 2000 is formed as a hollow part, with a layer of material surrounding a hollow space. To increase stiffness and rigidity, it may be desirable to mold pallet 2000 with one or more "tack off" areas, or areas in which opposing walls are molded close together, and in which hollow space inside the part is minimized or substantially eliminated. Platform 2120 includes a plurality of tack off areas in the form of circular recesses 2122 in the surface of the platform. Recesses 2122 extend across platform 2120 in two rows and two columns that intersect the rows. Pallets in accordance with the invention may have fewer or more tack off areas to provide the desired rigidity and stiffness to their platforms. Those skilled in the art will understand that tack off areas are completely optional. In the event that tack off areas are included, a number of sizes, shapes, spacings and arrangements of tack off areas can be used. For example, tack off areas may appear as shallow recesses or as through holes.

Pallet 2000 includes a bottom structure for receiving the neck portions of bottles positioned below the pallet. The bottom structure includes a base 2520 and columns 2540. Base 2520 and columns 2540 form a number of receptacles 2600. Each receptacle 2600 is adapted to surround at least a portion of and protect a neck portion N of a bottle received in the receptacle. Each receptacle 2600 has a first end 2620, a second end 2640 opposite the first end, and a sidewall 2650. First end 2620 includes a rim 2660 that surrounds an opening 2680. Each rim 2660 is configured to rest on a shoulder portion SH of a bottle. The shape of each rim 2660 is optimized to create as large a surface contact area as possible for the purpose of load distribution.

As noted earlier, pallets in accordance with the invention are designed for the public display of water bottles, including store displays. Therefore, it should be understood that many elements in the illustrated embodiments are primarily or exclusively ornamental, for display purposes. The ornamental elements may have a wide variety of shapes or configurations selected to meet aesthetic criteria. The appearance of these elements may be chosen to achieve a specific visual effect for the product display. As such, the ornamental appearance of the pallets as a whole, and individual features thereof, may be modified in an infinite number of ways within the scope of the invention to suit particular tastes. To the extent that these elements also perform function, the elements can incorporate an infinite number of ornamental features and still perform the same function.

For example, the shape, contours, and relative dimensions of the sidewall need not match the exact shape, contours, and relative dimensions of sidewall 240 in FIG. 3. Sidewall 240 has a uniform height and rounded corners to provide a sleek appearance on its exterior that is symmetrical, smooth and streamlined. The exterior of sidewall 240 resembles a band that wraps around the stack of bottles, providing a neat and organized look. This is in sharp contrast to a conventional pallet. Sidewalls in accordance with the invention may include various profiles and adornments. Instead of being linear, like sidewall 240, the sidewall may have a top edge that follows a sinusoidal wave. Ornamental aspects of the pallets, like the exterior appearance of the sidewall, can be selected to create a certain display theme or satisfy other aesthetic considerations, without influencing the function of the pallets.

While preferred embodiments of the invention have been shown and described herein, it will be understood that such embodiments are provided by way of example only. Numerous variations, changes and substitutions will occur to those skilled in the art without departing from the scope of the invention. Accordingly, it is intended that the appended claims cover all such variations.

What is claimed:

1. A pallet system comprising a first pallet, the first pallet comprising:

a tray portion comprising a generally flat platform for receiving, storing and transporting one or more first bottles on the first pallet, the generally flat platform having a perimeter edge; and a bottom structure comprising a pedestal portion extending beneath the tray portion, the pedestal portion comprising a substantially flat base and a plurality of columns that connect the tray portion to the base, the base and plurality of columns defining a plurality of apertures for receiving a fork on a fork lift or pallet jack, the base and plurality of columns further defining a plurality of receptacles, each receptacle having a rim, the receptacles adapted to surround and protect a neck portion of one or more second bottles arranged below the first pallet and at the same time distribute weight to the one or more second bottles arranged below the first pallet by resting the rims on shoulder portions of the one or more second bottles arranged below the first pallet, the pedestal portion thus being adapted to:

support the tray portion in a raised position above a surface when the first pallet is sitting on the surface;

receive a fork on a fork lift or pallet jack to permit the first pallet to be moved from the surface; and vertically stack the first pallet onto a second pallet containing the one or more second bottles arranged below the first pallet without damaging the neck portion of the one or more second bottles arranged below the first pallet.

2. The pallet system of claim 1, wherein the tray portion comprises a plurality of dividers extending upwardly from the platform, the dividers collectively forming a plurality of sockets for receiving the one or more first bottles in the tray portion.

3. The pallet system of claim 2, wherein the dividers comprise arc-shaped dividers.

4. The pallet system of claim 3, wherein at least some of the arc-shaped dividers are grouped in sets, each set consisting of four arc-shaped dividers.

5. The pallet system of claim 4, wherein the four arc-shaped dividers of each set are joined end to end, so that each set forms a diamond-shaped cluster of arc-shaped dividers.

6. The pallet system of claim 3, wherein the arc-shaped dividers are arranged on a plurality of circular outlines and define circular borders around the sockets.

7. The pallet system of claim 2, wherein the tray portion comprises a sidewall extending upwardly from the perimeter edge of the platform.

8. The pallet system of claim 7, wherein some of the dividers are arranged in series along the sidewall.

9. The pallet system of claim 8, wherein the dividers arranged in series along the sidewall extend tangentially to the sidewall.

10. The pallet system of claim 7, wherein the sidewall has a first height with respect to the platform, and the dividers have a second height with respect to the platform, the first height being greater than the second height.

11. The pallet system of claim 7, wherein the base of the pedestal portion comprises an outer edge, and the sidewall comprises an inner edge that defines an opening, the outer edge of the base having a size and shape substantially identical to the size and shape of the opening.

12. The pallet system of claim 11, wherein the pallet system comprises the second pallet, the second pallet having a configuration identical to the first pallet.

13. The pallet system of claim 12, wherein the base of the first pallet is configured for insertion into the opening formed by the sidewall on the second pallet to facilitate nesting of the first pallet in the second pallet.

14. The pallet system of claim 1, wherein the pedestal portion is configured to support the tray portion in a raised position above a surface on which the pedestal portion sits.

15. The pallet system of claim 1, wherein the plurality of columns are separated from one another by a plurality of apertures, each aperture formed between two of the columns.

16. The pallet system of claim 1, wherein the plurality of receptacles pass through the base and extend beneath the platform.

17. The pallet system of claim 1, wherein each receptacle comprises a sidewall that includes a relieved section, the relieved section defining a widened opening that provides clearance into the receptacle to reduce the incidence of racking.

* * * * *